United States Patent [19]

Reed

[11] Patent Number: 4,875,863

[45] Date of Patent: Oct. 24, 1989

[54] ELECTRICAL DEVICE HAVING IMPROVED LEADS FOR SURFACE MOUNTING ON A CIRCUIT BOARD

[75] Inventor: Carl G. Reed, Clemmons, N.C.

[73] Assignee: AMP Incorporated, Harrisburg, Pa.

[21] Appl. No.: 179,697

[22] Filed: Apr. 11, 1988

[51] Int. Cl.[4] ..... H01R 9/09

[52] U.S. Cl. ..... 439/79; 439/81; 439/83; 439/676

[58] Field of Search ..... 439/79–83, 439/629, 676

[56] References Cited

U.S. PATENT DOCUMENTS

| | | | |
|---|---|---|---|
| 4,210,376 | 7/1980 | Hughes et al. | 339/17 LC |
| 4,221,458 | 9/1980 | Hughes et al. | 439/79 |
| 4,457,575 | 7/1984 | Davis et al. | 439/676 |
| 4,497,526 | 2/1985 | Myers | 439/81 |
| 4,533,203 | 8/1985 | Feldman et al. | 339/176 M |
| 4,629,266 | 12/1986 | Viselli | 439/81 |
| 4,632,493 | 12/1986 | Matsuzaki et al. | 439/676 |
| 4,682,829 | 7/1987 | Kunkle et al. | 439/83 |
| 4,698,025 | 10/1987 | Silbernagel et al. | 439/79 |
| 4,699,595 | 10/1987 | Nakazawa et al. | 439/676 |
| 4,717,217 | 1/1988 | Bogese, II | 439/83 |

FOREIGN PATENT DOCUMENTS

| | | |
|---|---|---|
| 0147039 | 7/1985 | European Pat. Off. . |
| 3644153-A1 | 7/1988 | Fed. Rep. of Germany . |
| 2598856-A1 | 11/1987 | France . |

*Primary Examiner*—P. Austin Bradley
*Attorney, Agent, or Firm*—Eric J. Groen

[57] ABSTRACT

An electrical device intended for surface mounting has an insulating body and leads extending from the body. Each lead has an integral spring portion and an end portion. The insulating body has an aligning or locating stop and the lead adjacent to its end is biased against the locating stop by the integral spring. The locating stop thus ensures that the extreme ends of the leads will be in aligned coplanar relationship. The terminals are also formed with an integral spring which spring biases the lead portions against the stop means and spring biases a retention barb further into retentive condition.

22 Claims, 6 Drawing Sheets

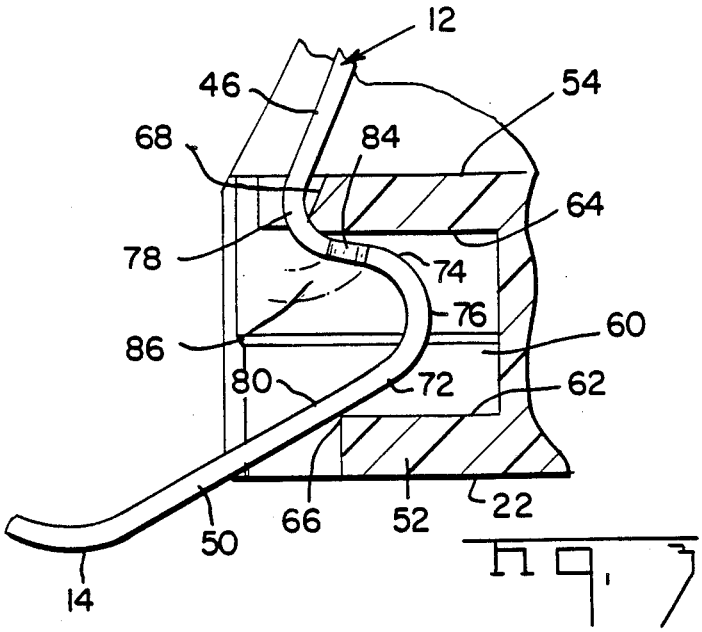
FIG. 3
FIG. 4
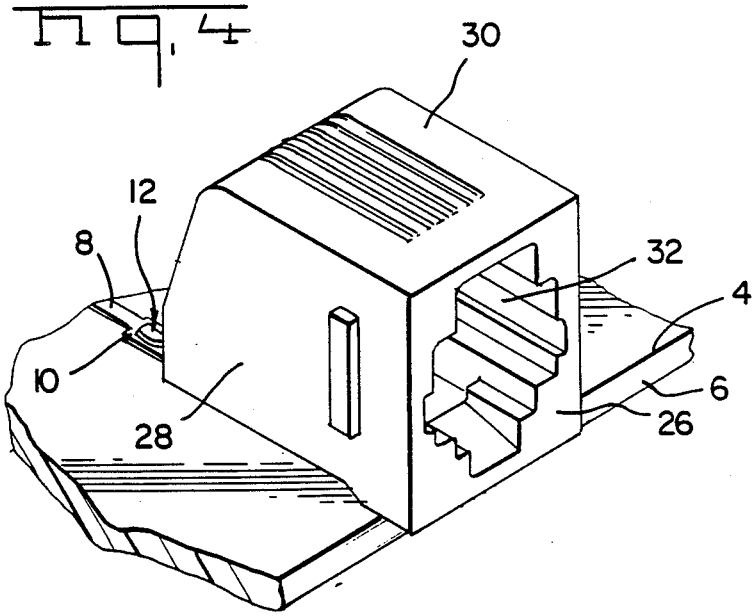

Fig. 5A
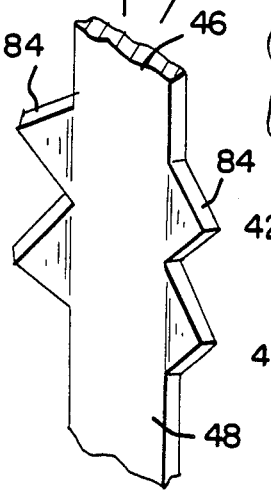
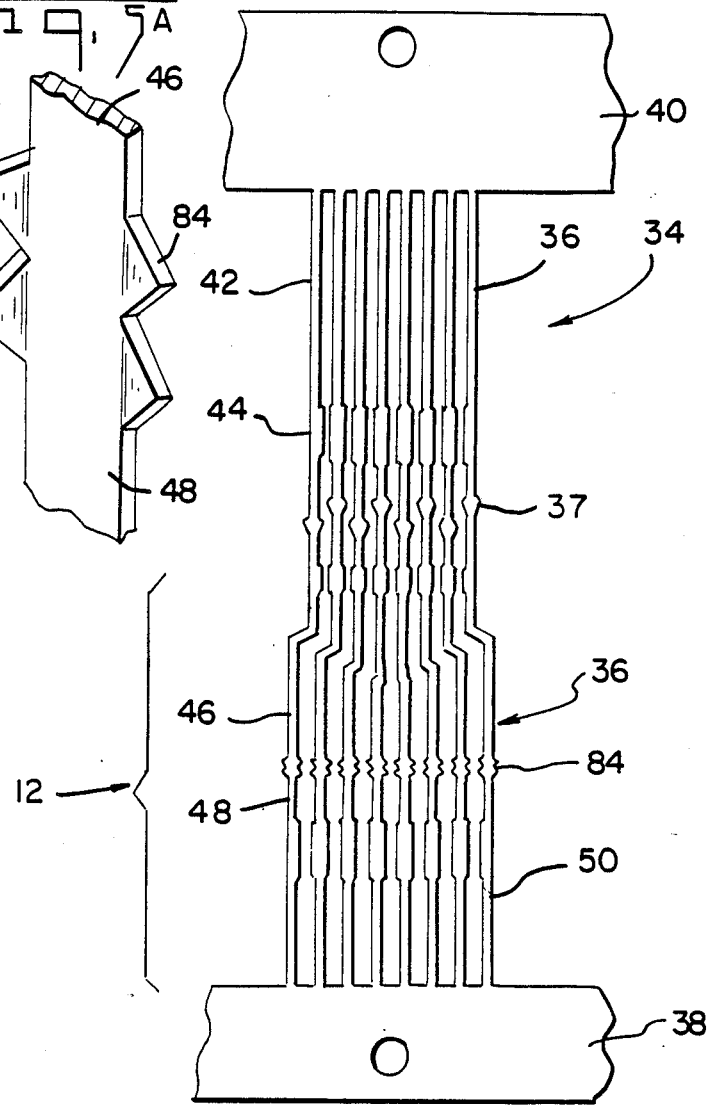
Fig. 5

ELECTRICAL DEVICE HAVING IMPROVED LEADS FOR SURFACE MOUNTING ON A CIRCUIT BOARD

FIELD OF THE INVENTION

This invention relates to electrical devices which are intended for surface mounting on one surface of a circuit board and particularly to improved leads for mounting such devices on circuit boards.

BACKGROUND OF THE INVENTION

It is becoming increasingly common practice to connect the leads extending from an electrical device to conductors on a circuit board by mounting the electrical device on the same surface of the circuit board as the surface upon which the circuit board conductors are provided. This surface mounting technique is carried out by providing terminal pads or areas on the circuit board conductors and contact portions on the leads extending from the electrical device which are positioned against the terminal pads. The pads are coated with a viscous solder composition and after placement of the electrical device on the surface of the circuit board, the solder composition is reflowed thereby to obtain the bond between each lead and its associated terminal pad.

One prior art connector is shown in U.S. Pat. No. 4,210,376 as having a plurality of electrical terminal portions for interconnection to printed circuit board through holes. The terminal portions of the connector are arranged in two spaced apart rows along the back side of the housing to position the lead ends into two staggered rows of terminals. This connector is also available in a surface mount version where the lead ends are bent upwardly for contact on the surface of the printed circuit board rather than through a hole in the printed circuit board.

There are several problems which must be addressed when the more conventional terminal post and circuit board hole mounting technique is replaced by a surface mounting technique. For example, the contact portions of the leads extending from the electrical device should be precisely located in coplanar relationship so that when the electrical device is positioned on the circuit board in preparation for the soldering operation, the contact portion of every one of the leads will be against the corresponding terminal pad on the circuit board. If one or more of the leads is not coplanar, the connector will have to be forced towards the board, to a position where all contact portions are contacting their respective surface mount pads. Successful execution of the reflow soldering operation requires that a certain amount of force be placed on the terminal pads through the contact portions of the terminals, such as through resilient deflection of the terminals when the connector is placed on the board. If the contact portions are not coplanar, the contacts which are in a plane closer to the board, will require a greater deflection than those contact portions which are spaced from the board, such that all contact portions mate with their respective pads on the surface of the board. This increased deflection on some of the terminals causes a proportionate increased amount of biasing force against the lead contact portions.

This increased force can cause the connector itself to unseat itself from the printed circuit board. The connector typically includes a retaining feature on the mounting face thereof, such as that shown in U.S. Pat. No. 4,195,900, incorporated herein by reference, which is profiled for receipt through apertures in the printed circuit board for retaining the connector to the housing. An increased biasing force in opposition to the retention member can cause the retention features to give way to the biasing force, unseating the connector housing from the surface of the printed circuit board.

One other difficulty which is encountered with a surface mount connector similar to the above described, relates to the side-to-side alignment of the lead ends, to ensure precise alignment of the lead ends on the printed circuit board. The lead ends are spaced at 0.050 inches between centers, thus precise alignment of the lead ends is required to ensure that the leads ends contact the printed circuit board pads, and that the lead ends do not contact each other.

It must also be recognized that surface mounted electrical devices inherently require more space on the circuit board than does a device mounted by means of terminal posts and circuit board holes for the reason that the leads must extend laterally a short distance away from the insulating body, such as a connector housing, of the electrical device. This requirement of additional circuit board space for surface mounted devices can be minimized but it cannot be eliminated. It is also desirable to mechanically isolate the soldered connections of the contact portions of the leads to the terminal pads of the circuit board from the insulating body of the electrical device in order to avoid or minimize the transmission of stresses from the device to the soldered joints.

The present invention is directed to the achievement of an improved surface mountable electrical device having leads extending therefrom which satisfy the requirements discussed above.

THE INVENTION

It is therefore an object of the invention to design a surface mount connector having lead contact surfaces arranged in a uniform plane.

It is a further object of the invention to design a connector having improved side-to-side alignment characteristics for precise alignment with printed circuit board pads.

The invention comprises an electrical device which is intended to be surface mounted on a circuit board surface, the device comprising an insulating body having a mounting surface which is opposed to, and proximate to, the circuit board surface when the device is mounted thereon, and a side surface which extends transversely of the mounting surface. A plurality of spaced apart leads extend from the side surface, each of the leads having an adjacent portion which is adjacent to the side surface and an end portion. The end portions have contact portions which are connected to circuit board conductors when the device is mounted on the circuit board surface. The device is characterized in that the side surface has locating portions and each lead has a locating portion which adjoins its end portion, the locating portions of the leads being against the locating portions on the side surface whereby the locating portions of the leads are in coplanar relationship by virtue of their being against the locating portions on the side surface and the end portions of the leads are maintained in coplanar aligned relationship by the locating portions.

Advantageously, a spring portion is provided adjacent to the locating portion of each lead, the spring portion functioning resiliently to bias the locating portion against the locating portions. In one embodiment, the insulating body has recess means on the side surface thereof and the spring portion of each lead is in the recess means. In a preferred embodiment, the spring portion of each lead is generally U-shaped and has a first arm, a second arm, and a bight portion. The first arm is proximate to a first recess surface and a second arm is proximate to a second recess surface, the first and second recess surfaces being opposed to each other with the first recess surface being proximate to the mounting surface. The U-shaped spring portion is formed by tucking a portion of an elongated lead into the recess means when the lead is assembled to the insulating body.

In a related aspect of the invention, an insulative housing is provided which comprises a mating face and a mounting face, the housing means further comprising means for lateral and coplanar alignment of electrical terminals within the housing, the alignment means comprising a recess formed within the housing means including a flange and two walls which are transverse to the flange. Electrical terminal means are also included and have a contact portion for interconnection to a complementary connector and lead portions for interconnection to the surface of the printed circuit board, the lead portions of the terminal means having side edges in engagement with the surfaces of the two walls. The lead portions are disposed within the alignment means at an acute angle relative to the flange which provides a long span of engagement between the lead portions and the two walls providing for lateral alignment of free ends of the lead portions. The lead portions are arranged at a precise acute angle and in a contacting relation with the flange providing for coplanarity of the lead ends. In the preferred embodiment of the invention the lead portions are spring biased against a lip portion of the flange.

The electrical device may be an active device, such as a transistor or integrated circuit, or it may be a passive device such as an electrical connector.

THE DRAWING FIGURES

FIG. 3 is an enlarged fragmentary view showing details of a mounting lead and illustrating the manner in which the leads are maintained in coplanar relationship.

FIG. 4 is a perspective view showing the connector mounted on the circuit board.

FIG. 5A is an enlarged view of the retention barb which is located on the terminal.

FIG. 8 is a view similar to FIG. 3 but showing an alternative embodiment.

THE DISCLOSED EMBODIMENT

Figure 1:
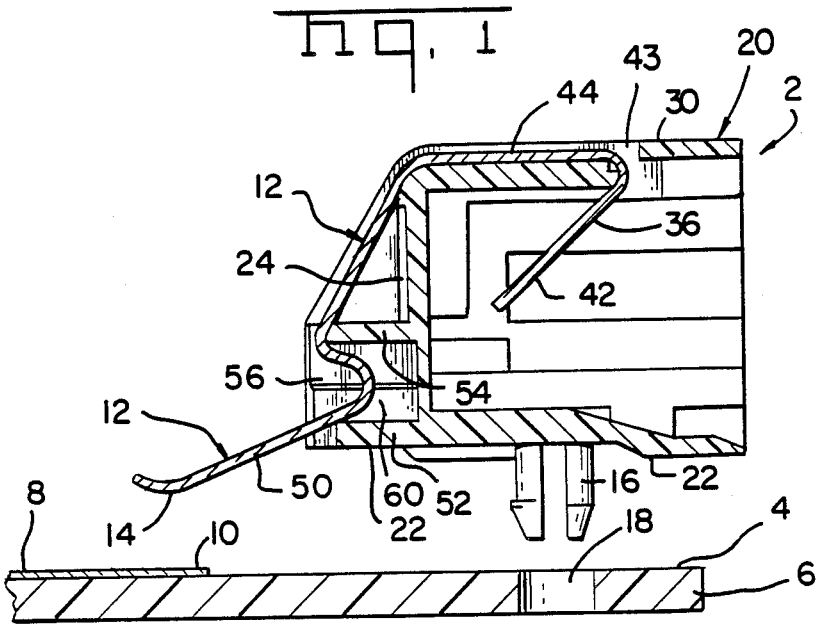
FIG. 1 is a cross sectional view of a connector which is spaced from the mounting surface of a circuit board.

FIG. 1 shows an electrical connector 2 which is positioned above the mounting surface 4 of a circuit board 6 in preparation for mounting of the connector on the circuit board. The connector shown is of the general type described fully in U.S. Pat. No. 4,210,376 which is hereby incorporated by reference in its entirety. The connector shown in the drawing has improved conductors which have lead portions that are particularly adapted for surface mounting on a circuit board surface. The general features of the connector will be described only briefly and to the extent necessary for an understanding of the present invention. Those features of the conductors and leads which pertain to the instant invention will be described in detail.

Figure 2:
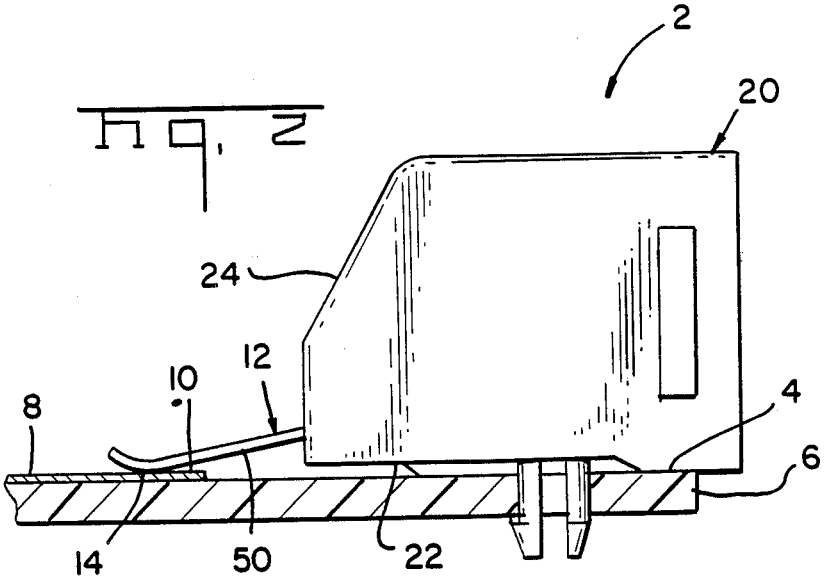
FIG. 2 is a side view showing the connector mounted on the circuit board.

The mounting surface 4 of the circuit board 6 has circuit board conductors 8 thereon which extend to terminal pads 10. The housing 20 of the connector has integral mounting posts 16 which are received in holes 18 in the circuit board. The ends 50 of the leads which extend from the connector housing have contact portions 14 which are intended to be connected by soldering to the terminal pads 10. The connector is assembled to the circuit board by moving it downwardly from the position shown in FIG. 1 to the position shown in FIGS. 2 and 4 so that the mounting posts 16 enter the holes 18 and the contact portions 14 of the lead ends 50 are located against the terminal pads 10. The terminal pads 10 are coated with a viscous solder composition which can be reflowed to establish a bond between the contact portions 14 and the terminal pads 10.

Successful execution of surface mounting processes requires that the contact portions 14 be against the terminal pads 10 when the soldering process is carried out and preferably these contact portions should be resiliently biased against the terminal pads with a force sufficient to ensure good electrical contact when the solder is reflowed. The structural features of the leads and the connector housing which achieve these objects are described in detail below.

As shown in FIG. 1, the connector 2 comprises an insulating housing 20 having a downwardly facing, as viewed in the drawing, mounting surface 22, a rear side surface 24 which extends transversely of the mounting surface, a mating face 26, (FIG. 4) oppositely facing external end walls 28, (FIG. 4) and an external top wall 30. A plug receiving opening 32 extends inwardly from the mating face 26 and is dimensioned to receive a standard modular plug of the type used in telephone and other electronic circuits.

Figure 5:
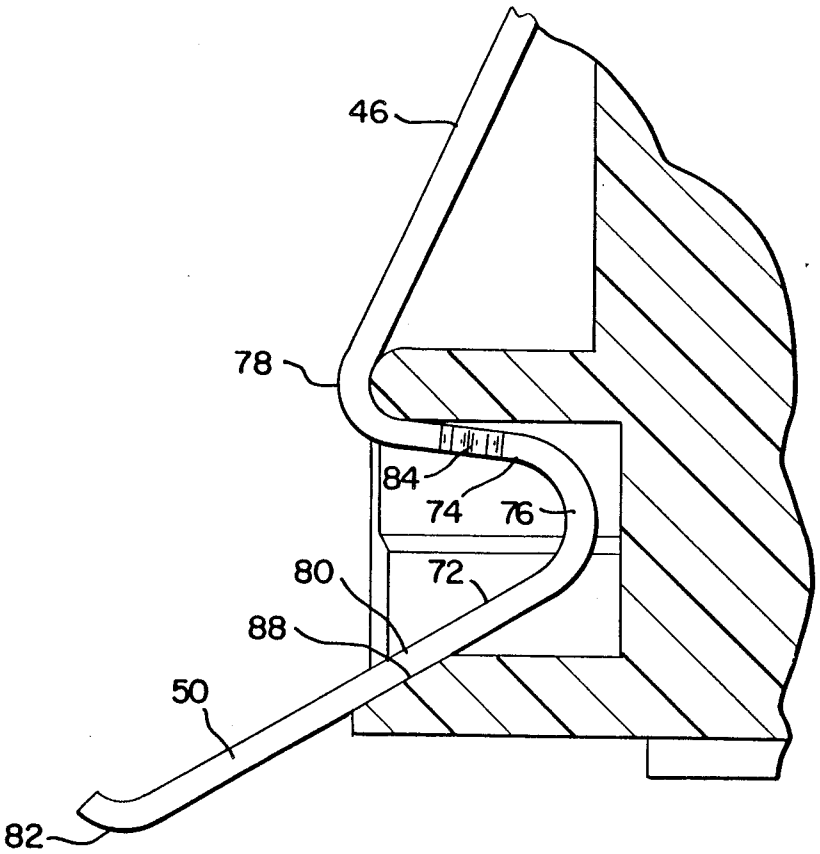
FIG. 5 is a plan view of a lead frame which contains a plurality of connector conductors which are assembled to a connector housing in the manner shown in FIGS. 6 and 7.

The housing contains a plurality of sheet metal conductors 34 which are manufactured by stamping and forming, and are originally configured as a lead frame, as shown in FIG. 5. Each lead frame contains the number of individual sheet metal conductors 34 which are required for an individual housing. The conductors 34 are integral at their ends with spaced apart carrier strips 38, 40 which are sheared from the ends of the conductors when the conductors are assembled to the connector housing as described below. As shown in FIG. 5, each conductor 34 has a spring arm contact portion 42, an intermediate portion 44 which is located on the top wall 30 of the housing, and a lead portion 12. Each of the lead portions 12 comprises an adjacent portion 46, an intermediate portion 48, and an end portion 50. The adjacent portion 46 is adjacent to the side surface 24; the intermediate portion 48 is formed into a spring as will be described below, and the end portion 50 extends away from the side 24 of the housing and has the contact portion 14 on its extreme end. Barbs 37 are provided on the portions 44 of the conductors to anchor the conductors in shallow channels which extend inwardly on the housing top wall to secure them in place. Barbs 84 are included on the intermediate portions 48 to anchor the terminals to the rear side wall 24. The barbs are shown in greater detail in FIG. 5A as including individual teeth which allow easy entry into the channels, and which lock the terminals within the channels once inserted.

Figure 9A:
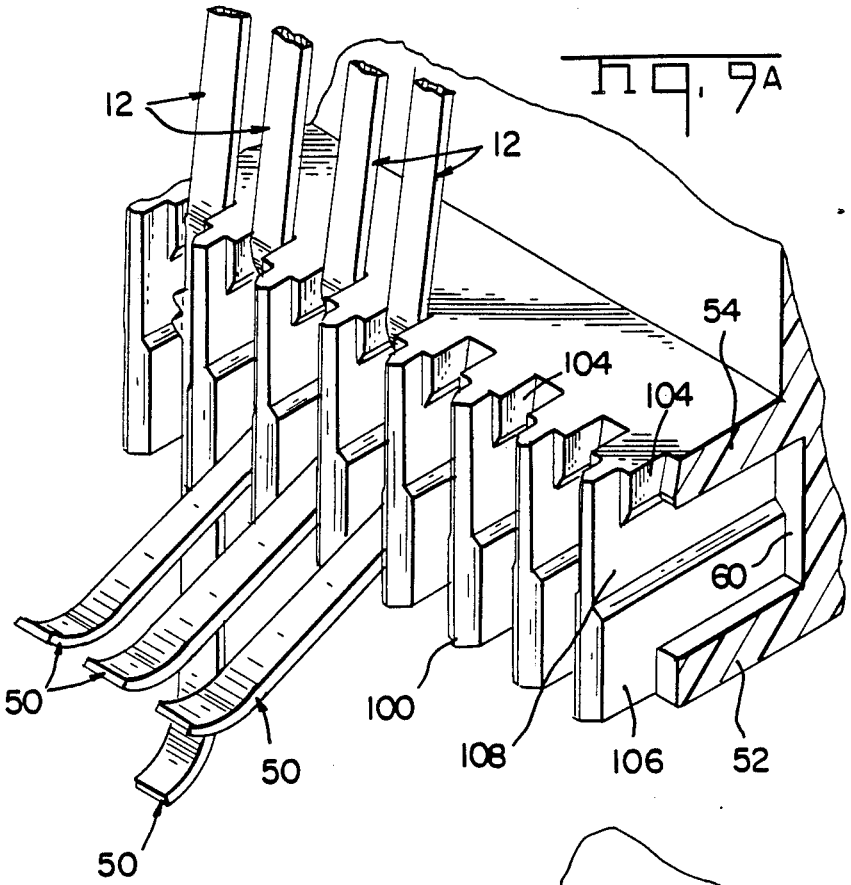
FIG. 9A is an isometric view of the housing partially broken away to show the internal characteristics of the housing.

As shown in FIG. 9A, the rear side surface 24 includes a plurality of upstanding walls 100 extending outwardly therefrom which form between them, upright channels for receipt of the terminals. Each of the walls includes raised surfaces 104 and 106, and recessed surfaces 108, which will be described more fully herein. However, it should be noted that the raised surfaces 104 and 106, of two adjacent walls, face each other to form constricted passageways, while the surfaces 108 face each other, but provide a larger spacing therebetween.

In addition to the walls 100, the rear side surface 24 of the housing has first and second spaced apart flanges 52, 54 extending therefrom in a parallel manner relative to the board. Each of the flanges is integral with, and extends between two of the adjacent walls 100. The first flange 52 is adjacent to the mounting surface 22 while the second flange 54 is spaced from the mounting surface. The two spaced apart flanges 52 and 54, in combination with the two walls 100 form individual recesses 60 between the walls 100. As shown in FIG. 3, each of the recesses 60 has opposed first and second recess surfaces 62, 64 which are proximate to, and spaced from, the mounting surface respectively. The first flange 52 has a first lip 66 at its mouth end, while the second flange has a second lip 68 at its mouth end. The first and second lips are at the lower and upper ends, respectively, of the channels which are provided in the first and second flanges.

Figure 6:
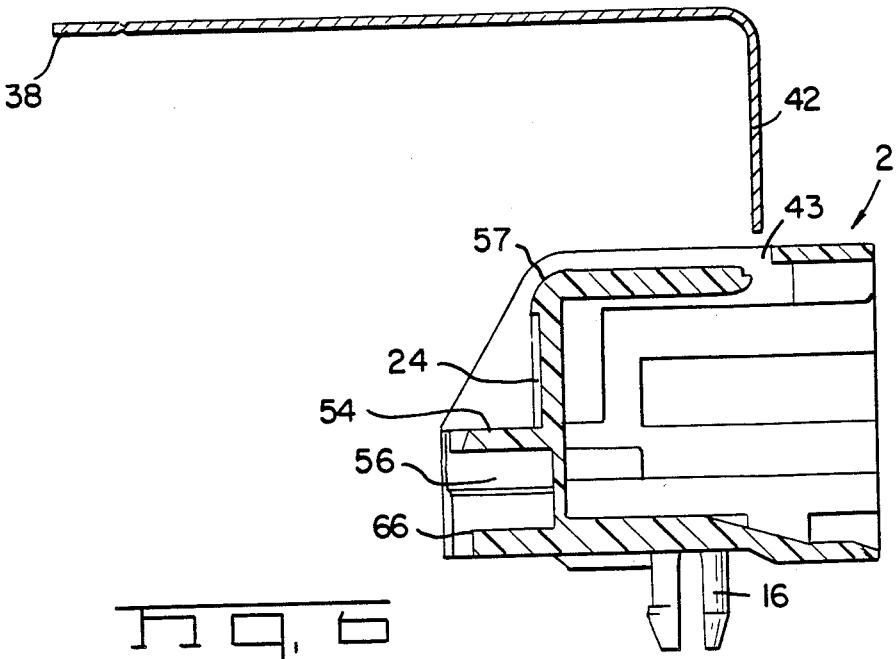
FIGS. 6 and 7 are sectional side views of a connector housing which illustrate the manner of assembling the connector conductors to the connector housing.
Figure 7:
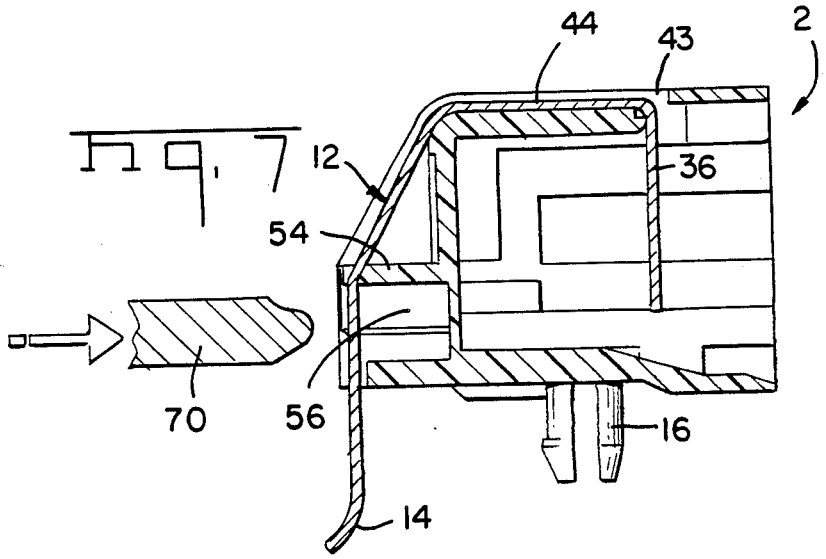

Referring now to FIGS. 5–7, when the connector conductors 34 are assembled to the connector housing, the carrier strip 40 is severed from the lead frame and the terminal portions 36 are bent normally of the intermediate portions 44 to form contact portions 42. The contact portions 42 are then moved downwardly through spaced apart openings 43 in the top wall 30 of the housing and the intermediate portions 44 can be moved into the shallow channels in the top wall. The lead portions 12 comprising terminal sections 46, 48, and 50 will then extend rearwardly beyond the back wall 24 of the housing. These lead portions are then bent downwardly and are positioned in the channels between adjacent walls 100, and adjacent to first and second lip portions 66, 68 of flange 52, 54, as shown in FIG. 7. Conveniently, when the terminal lead sections are in the position shown in FIG. 7, the barbs 84 will skive into the surfaces 108 (FIG. 9A) of the walls 100, to secure them in place prior to the final forming operation. A forming tool 70 is then moved against the intermediate portions 48 of the leads and serves to tuck these portions into the individual recesses 60. The second flange member 54 acts as a mandrel for the forming of the contact portion 48 therearound. The portions 48 are bent around the second lip 68 as shown and a generally U-shaped spring is thereby formed in each lead. To the extent that the first flange 52 cooperates with the second flange in the forming operation of the spring, the two flanges can be thought of as dies which cooperate with the tool member 70 for the forming operation.

As shown in FIG. 3, each spring has a first arm 72 which is adjacent to the first recess surface 62, a second arm 74 which is adjacent to the second recess surface 64, and a bight portion 76. The second arm 74 of each spring is connected by a transition section 78 to the associated adjacent lead portion 46. The portion 80 of each lead which extends from the mouth of its associated recess and over the first lip portion 66 serves as an aligning or locating portion in that it maintains the end portions 50 of the leads in coplanar relationship.

After the forming tool is withdrawn, the formed springs will be as shown in FIGS. 1 and 3. The leads are severely bent by the forming tool when the U-shaped spring members are formed and when the forming tool is withdrawn, the individual leads tend to "spring back", that is they tend to partially return to their original configuration. The phenomenon of spring back can be observed if one bends a piece of sheet metal through a 90 degree angle and then releases it. Depending upon the temper of the metal, the bent piece after release will move slightly back towards its original position so that the finished bent section of metal will not have a 90 degree bend. Ordinarily, this phenomenon of spring back is regarded as a problem in metal forming operations and must be taken into consideration when a stamped and formed metal part is designed. In fact, the very reason for providing the retention means or barbs 84, is for the spring back of the 46 which lies adjacent to the rear side wall 24, as it tends to return to its original horizontal position.

In the practice of the instant invention, however, the spring back phenomenon works to the advantage of the finished product in that the end portion 50 of each lead 12 is resiliently biased against the first lip portion 66, the locating portion, of the associated recess 60. The housing itself is of molded plastic material and is, for that reason, precisely dimensioned. It follows that since the aligning or locating portions of the leads are biased against the first lip portions, and the first lip portions are precisely aligned with each other, the end portions 50 of the lead and the contact portions thereof will be held in precise coplanar relationship.

It will be apparent from FIG. 1 that the contact portions 14 are below the mounting surface 22 of the housing. By virtue of this feature, the end portions of the leads will be flexed upwardly, as viewed in FIG. 1, when the connector is mounted on the circuit board surface 4. The contact portions will, as a result, be resiliently biased against the terminal pads; and sufficient and uniform electrical contact between the contact portions 14 and the terminal pads 10, will be assured.

Furthermore, the terminals are fixedly arranged within the channels due to the side edges of the terminals in an engaging manner with the surfaces 104 and 106. The terminals are fixed at two points along their length, that is, between the two surfaces 104, and between the two surfaces 106. This assures that the long beam length of the terminals, due to the intermediate spring, is sufficiently supported and aligned, relative to the lateral dimension. Furthermore, the beam portion 80 is at an acute angle relative to a height of the surface 106, assuring that a long span of terminal is aligned and straightened by the constriction formed by the two facing surfaces 106 (FIG. 9A). All of the above features cooperate to assure that the contact portions 14 which extend rearwardly, and which are spaced from, the rear side wall 24 of the housing are precisely aligned and spaced laterally for precise location with the terminal pads 10 on the printed circuit board.

As discussed above, a retention barb 84 is provided as shown on the second arm 74 of each spring member, and during formation of the spring member, the leg portion 74 swings on arcuate path around the lip 68 of the second flange portion thereby causing the barb 84 to skive an arcuate path 86 toward the second side surface 64 of the flange 54. Said differently, when the forming tool is projected into the channels to force the individual terminals into individual recesses 60, the barbs 84 are swung through an arcuate path 86 which skives the recessed surfaces 108 of the walls 100. As mentioned above, when the forming tool seats the terminals within the recesses 60, each formed terminal includes a U-shaped spring, formed by the terminal portions 72, 74 and 76.

It should be appreciated that metal spring back works to an advantage once again. As the spring is positioned between the two flanges 52 and 54, and as the leg portion 72 of the spring is resiliently biased against the lip 66 of the flange 52, an upward reaction force is placed upon the leg 72, which carries through to leg portion 74. This results in the retention barb being forced upwardly further towards the second recess surface 64. Advantageously, this spring force always forces the barb deeper into unskived material, as the barb is forced further in its arcuate path, rather than attempting to retreat through its original footprint. The same is true when the connector is placed upon the board, as the reaction force against the contact portion 14 will be upward, and will attempt to further seat the barb 84 within the plastic.

As mentioned above, the second lip portion 68 is used as a mandrel for the forming of the arcuate path of the terminal portion 74. The upper corner 57 of the housing is used as a mandrel for the forming of the terminal portion 46, which, as it should be noted, is of a larger radius than the forming radius of terminal portion 74. To unseat the terminal from the housing at the rear side, would require that the terminal portion 46 return through its original swing path. This would require the barbs 84 to skive through the surfaces 108 of the walls 100. What is important to note, is that the barbs would have to skive through plastic material which has not yet been cut.

As can be appreciated to one knowledgeable in the area of retention features such as barbs skiving into plastic, the removal of the terminal from the housing rear side wall 24 would not just require that the barbs skive through uncut plastic. Rather, as the barbs 84 skive through the plastic material on its original arc, the plastic material flows, or parts, to form somewhat of a channel. Thus, if the barbs were to be unseated from the rear side wall 24 of the housing the barb 84 would also have to cut through, or ride over, the plastic material which flowed to form the skived channel. Furthermore, since the removal of the terminal would require the terminal portion to swing through its original path or arc, the barbs would have to swing through the raised surface 104.

Figure 9B:
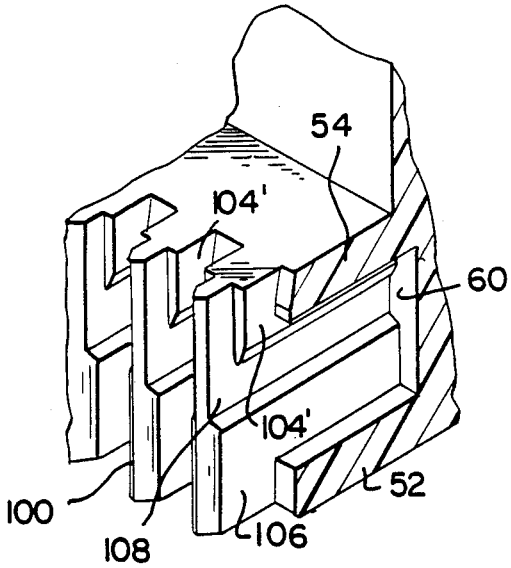
FIG. 9B is a view similar to that of FIG. 9A showing an alternative embodiment of the housing.

FIG. 9B shows an alternate housing where the walls have surfaces 104' which extend lower into the housing such that when the barbs are swung in, the barbs skive into the raised surface 104'.

FIG. 8 shows an alternative embodiment in which the first lip, against which the first arm is biased, comprises an inclined surface 88 rather than a sharp edge. Under some circumstances, this alternative may be preferable.

It will be apparent from the foregoing description that an electrical device having surface mounting leads in accordance with the invention can be made to occupy a minimum amount of space on the circuit board on which the device is mounted and will nonetheless have coplanar contact portions on the leads. The assembly of the connector conductors (including the lead portions of the conductors) to the connector housing can be carried out with relatively simplified tooling and in an extremely short time. The invention can be used in a wide variety of electrical devices when surface mounting of such devices is required. The spring associated with each conductor and the recess can take a wide variety of forms. An important element of the invention is the locating surface or lip 66 in combination with the spring which forces the end portion of each conductor against the locating surface. The spring also forces a retention barb further into uncut plastic material, to retain the terminals within the housing.

I claim:

1. An electrical device which is intended to be surface mounted on a circuit board surface, the device comprising an insulating body having a mounting surface which is opposed to, and proximate to, the circuit board surface when the device is mounted on the circuit board surface, a side surface which extends transversely of the mounting surface, and a plurality of spaced apart leads which extend from the side surface, each of the leads having an adjacent portion which is adjacent to the side surface and an end portion which extends away from the side surface, the end portions having contact portions which are connected to circuit board conductors when the device is mounted on the circuit board surface, the device being characterized in that:

the side surface has locating stop portions and each lead has a lead locating portion which adjoins its end portion, the lead locating portions being resiliently biased against the locating stop portions when in the unconnected condition of the device, whereby, the lead locating portions are coplanar by virtue of their being against the locating stop portions, and the end portions are maintained in coplanar aligned relationship by the lead locating portions.

2. A device as set forth in claim 1 characterized in that each lead has a spring portion which is adjacent to its lead locating portion, the spring portion functioning resiliently to bias the lead locating portion against the associated locating stop portion.

3. A device as set forth in claim 2 characterized in that lip means are provided on the side surface, the lip means being spaced from the side surface, the locating stop portions being on the lip means.

4. A device as set forth in claim 3 characterized in that the locating stop portions are edges on the lip means.

5. A device as set forth in claim 3 characterized in that the locating stop portions are inclined surfaces on the lip means.

6. A device as set forth in claim 2 characterized in that the insulating body has recess means on the side surface thereof, the spring portion of each lead being in the recess means.

7. A device as set forth in claim 6 characterized in that the recess means has opposed first and second recess surfaces, the first recess surface being proximate to the mounting surface, the second recess surface being remote from the mounting surface, the recess means having a recess mouth and first and second lip portions which adjoin the first and second recess surfaces respectively, the spring portion of each lead being in the recess means, the locating stop portions being on the first lip portion.

8. A device as set forth in claim 7 characterized in that the first lip portions are inclined towards the mounting surface of the insulating body.

9. A device as set forth in claim 8 characterized in that the spring portion of each lead is generally U-shaped and has a first arm, a second arm, and a bight portion, the first arm being proximate to the first recess surface, the second arm being proximate to the second recess surface.

10. A device as set forth in claim 9 characterized in that each lead has a transition section between its adjacent portion and its spring portion, the transition section being bent around the second lip portion and merging with the second leg portion.

11. An electrical device which is intended to be surface mounted on a circuit board surface, the device comprising an insulating body having a mounting surface which is opposed to, and proximate to, the circuit board surface when the device is mounted on the circuit board surface, a side surface which extends transversely of the mounting surface, and a plurality of spaced apart leads which extend from the side surface, each of the leads having an adjacent portion which is adjacent to the side surface and an end portion which extends away from the side surface, the end portions having contact portions which are connected to circuit board conductors when the device is mounted on the circuit board surface, the device being characterized in that:

the insulating body has recess means on the side surface, the recess means having opposed first and second recess surfaces which extend normally of the side surface, the first recess surface being proximate to the mounting surface, the second recess surface being remote from the mounting surface, the recess means having a recess mouth and having first and second lip portions which adjoin the first and second recess surfaces respectively, each lead has a re-entrant intermediate portion between its end portion and its adjacent portion, the re-entrant portions extending from the adjacent portions into the recess means and out of the recess means to the end portion, the re-entrant portions being compressed U-shaped springs and resiliently biasing the first arm portion against the first lip portion whereby, the end portions of the conductors, including the contact portions, are coplanar and all of the contact portions will be against the circuit board conductors when the device is placed on the circuit board surface.

12. A device as set forth in claim 11 characterized in that the device is an electrical connector.

13. A device as set forth in claim 11 characterized in that the first and second recess surfaces extend substantially parallel to the mounting surface.

14. A device as set forth in claim 11 characterized in that each U-shaped spring has a first arm, a second arm, and a bight portion, the first arm being proximate to the fist recess surface, the second arm being proximate to the second recess surface.

15. A device as set forth in claim 14 characterized in that the first lip portion has an edge, the first arm of each spring being resiliently biased against the edge.

16. A device as set forth in claim 14 characterized in that each lead has a transition section between its adjacent portion and its U-shaped spring, the transition section being bent around the second lip portion and merging with the second leg portion.

17. A device as set forth in claim 16 characterized in that the first lip portion in an inclined surface which intersects the first recess surface, the end portion of each lead extending from the side surface at the angle of inclination of the inclined surface.

18. An electrical device, such as a modular jack, which is intended to be mounted on a circuit board surface, the device comprising an insulating housing having a mounting surface which is opposed to, and against, the circuit board surface when the device is mounted thereon, a top wall, a mating face, a rear side surface, and oppositely directed endwalls, the mating face having a plug receiving opening extending therein for reception of a modular plug, a plurality of stamped and formed conductors, each of the conductors having a spring arm contact portion which is within the plug receiving opening, an intermediate portion which extends along the top wall to the rear side surface, and a lead portion which extends along, and laterally away from, the rear side surface, the device being characterized in that:

the insulating body has recess means on the side surface, the recess means having opposed first and second recess surfaces which extend normally of the side surface, the first recess surface being proximate to the mounting surface, the second recess surface being remote from the mounting surface, the recess means having a recess mouth and having first and second lip portions which adjoin the first and second recess surfaces respectively, the lead portion of each lead comprises an adjacent portion, a spring portion, and an end portion, the adjacent portion extending from the top wall to the second lip portion, the end portion extending away from the first lip portion and being inclined past the mounting surface, the spring portion of each lead being within the recess means and being compressed, the spring portion serving to bias the end portion against the first lip portion.

19. An electrical device as set forth in claim 18 characterized in that the mounting surface has means thereon for securing the housing to a circuit board with the mounting surface substantially against the circuit board surface whereby, upon mounting the device on a circuit board, the end portions of the leads are flexed away from the first lip portions and are resiliently biased against terminal pads on the circuit board surface.

20. An electrical device as set forth in claim 19 characterized in that the spring portion of each lead portion is generally U-shaped and comprises a first arm, a second arm, and a bight, the first arm being proximate to the first recess surface, the second arm being proximate to the second recess surface, each lead portion having a transition section between its spring portion and its adjacent portion, the transition portion being wrapped around the second lip portion.

21. An electrical connector for surface mount interconnection to terminal pads on printed circuit boards, comprising:

an insulative housing means having a mating face and a mounting face, the housing means further comprising means for lateral and coplanar alignment of electrical terminals within the housing, the alignment means comprising a recess formed within the housing means including a flange and two walls which are transverse to the flange; and electrical terminal means including a contact portion for interconnection to a complementary connector and lead portions for interconnection to the surface of the printed circuit board, the lead portions of the terminal means having side edges in engagement with the surfaces of the two walls, the lead portions being disposed within the alignment means at an acute angle relative to the flange which provides a long span of engagement between the lead portions and the two walls providing for lateral alignment of free ends of the lead portions; the lead portions arranged at a precise acute angle and in a contacting relation with the flange providing for coplanarity of the lead ends.

22. The connector of claim 21 wherein the lead portions are spring biased against a lip portion of the flange.

* * * * *